United States Patent [19]

Hihara et al.

[11] Patent Number: 4,966,463

[45] Date of Patent: Oct. 30, 1990

[54] MIXER UNIT FOR CELLULAR CONCRETE PASTE AND METHOD OF MAKING SUCH PASTE

[75] Inventors: Mikio Hihara; Nobuhisa Suzuki, both of Fuji, Japan

[73] Assignee: Nisset Plan, Inc., Japan

[21] Appl. No.: 234,948

[22] Filed: Aug. 22, 1988

[30] Foreign Application Priority Data

May 17, 1988 [JP] Japan ..... 63-119739
May 17, 1988 [JP] Japan ..... 63-119740

[51] Int. Cl.[5] ..... B01F 13/02

[52] U.S. Cl. ..... 366/3; 366/14; 366/18; 366/27; 366/41; 366/155

[58] Field of Search ..... 366/14, 15, 16, 17, 366/18, 27, 40, 41, 42, 68, 155, 154; 261/DIG. 26

[56] References Cited

U.S. PATENT DOCUMENTS

| | | | |
|---|---|---|---|
| 1,645,378 | 10/1927 | Fender | 366/155 |
| 1,877,337 | 9/1932 | Kampf et al. | 366/155 X |
| 2,199,289 | 4/1940 | Johnson | 366/41 |
| 2,264,039 | 11/1941 | Hoya | 366/41 |
| 2,460,605 | 2/1949 | Soissa | 366/155 X |
| 3,066,831 | 12/1962 | Thompson | 366/155 X |

*Primary Examiner*—Frankie L. Stinson

[57] ABSTRACT

A cellular concrete paste mixer unit is provided consisting of a first mixer and an increased number of second mixers. The mixer unit is able to simultaneously produce cement paste and cellular concrete paste. A method of making cellular concrete paste using the claimed mixer unit is also provided.

5 Claims, 2 Drawing Sheets

MIXER UNIT FOR CELLULAR CONCRETE PASTE AND METHOD OF MAKING SUCH PASTE

BACKGROUND OF THE INVENTION

Figure 1:
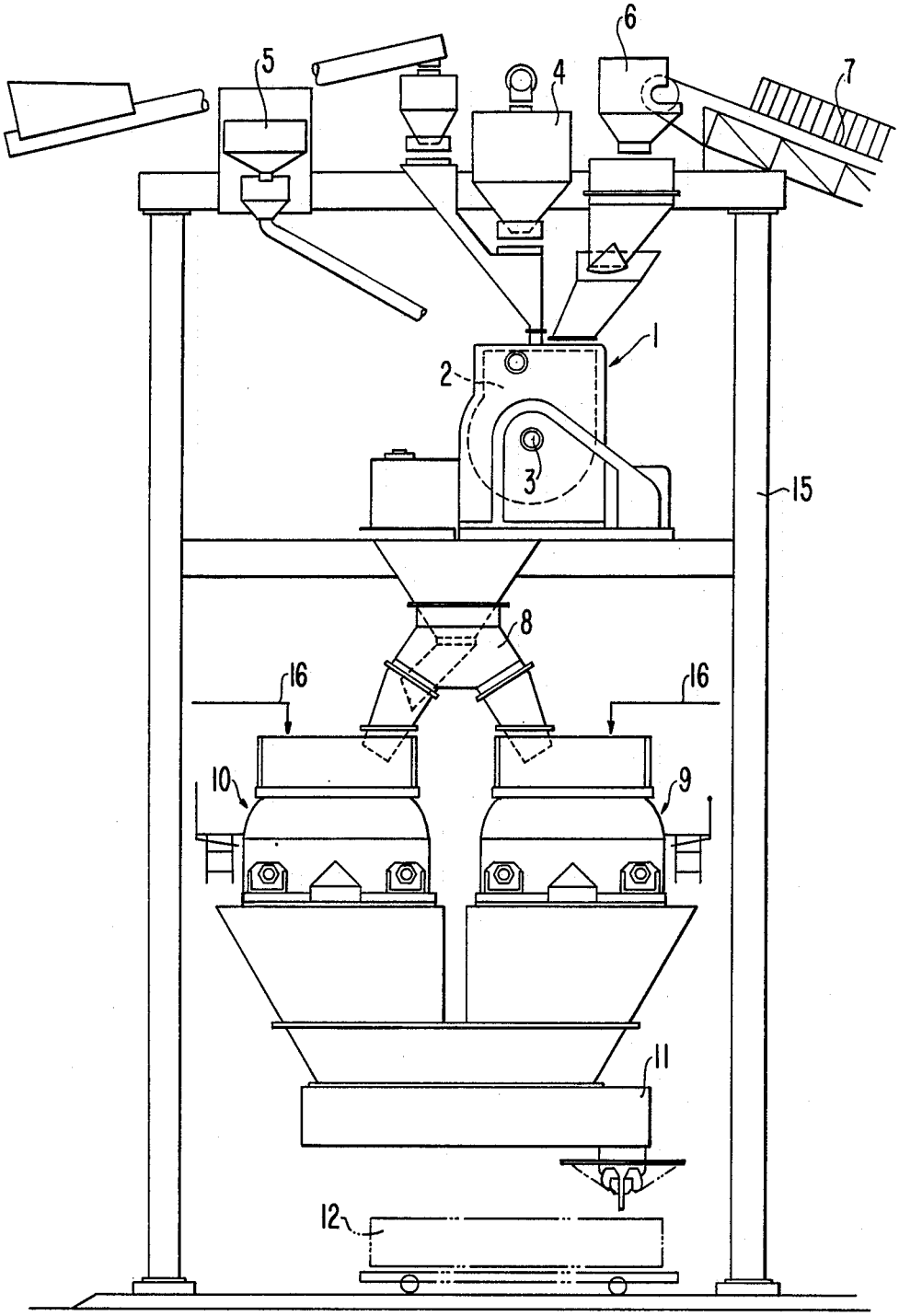

The present invention relates to a mixer unit for the production of cellular concrete paste, and a method of making such paste. More particularly the present invention relates to a cellular concrete mixer unit having first mixers and an increased number of second mixers, connected to each other through a connection having a change-over. The present invention also relates to the method of making cellular concrete paste using such a mixer unit, in which cellular concrete paste is continuously manufactured without defoaming.

The light weight, heat insulation, fire resistance, and sound insulation characteristics of cellular concrete have allowed it to find a definite niche in the field of building materials.

The process of producing cellular concrete is generally divided into two types: (1) to make a cement paste foam in a form after mixing all the ingredients and (2) to mix a cement mortar with a bubbled frother solution, followed by casting this cellular concrete paste into a form. The latter method is widely used since it can make it easy to manufacture the desired form of cellular concrete. Mixer units are commonly used to produce such cellular concrete paste. The conventional mixer unit available for the production of cellular concrete paste comprises a single mixer. However, this type of unit has a problem of taking too much time to manufacture a great amount of cellular concrete products. Also, it has a difficulty in producing a uniform cellular concrete paste without defoaming.

SUMMARY OF THE INVENTION

In accordance with the present invention, a cellular concrete paste mixer unit is provided that consists of first mixers and an increased number of second mixers, connecting with each other through a connection having a change-over valve, and the method of making continuously cellular concrete paste without defoaming, using such unit.

In the operation of the mixer unit of the invention, cement is mixed with water and often together with aggregate in the first mixer; the mixture is blended and transferred from the first mixer through the connection having a change-over valve into one of the second mixers, to which a bubbled frother solution is simultaneously fed with agitation; and the mixture is blended to form a cellular concrete paste while the next batch of ingredients are mixed in the first mixer and transferred to another second mixer. This procedure is continuously repeated so that all the mixers are always occupied.

Since the specific gravity of bubbled frother solution is very low as compared with that of cement mortar, it is very difficult to mix each other using a prior art mixer unit having a single mixer. On the other hand, the mixer unit of the invention enables the simultaneously feeding of cement mortar and frother solution into the second mixers at a desired rate with agitation, resulting in uniformity of cellular concrete paste and less defoaming.

In the production of cellular concrete paste, the volume of cement mortar greatly increases after addition of aerated frother solution. For this reason, the prior art mixer unit having a single mixer has to blend only a small volume of cement mortar before addition of bubbled frother solution. Also, the next batch of cement mortar must be blended only after the preceding cellular concrete paste has been removed. On the other hand, since the mixer unit of the invention has an increased number of second mixers which may have a larger capacity, the first mixer can blend a capacity of cement mortar while simultaneously allowing the second mixer to blend the preceding cement mortar with a bubbled frother solution. This results in higher efficiency of the production of cellular concrete paste.

The number and capacity of the second mixer of the invention may be increased, depending upon the volume of bubbled frother solution to be added, as the time of mixing cement paste with bubbled frother solution is usually longer than that of the production of the cement mortar.

The following Examples are illustrative and represent preferred embodiments of cellular concrete paste mixer unit in accordance with the invention, and the method of making continuously cellular concrete paste without defoaming using such unit.

Figure 3:
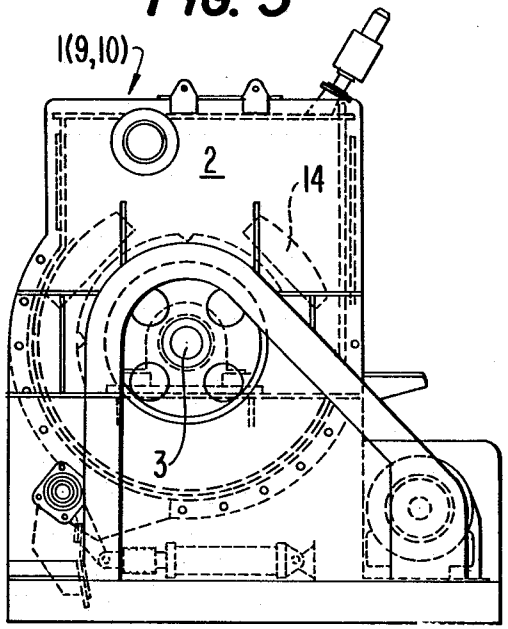
Figure 2:
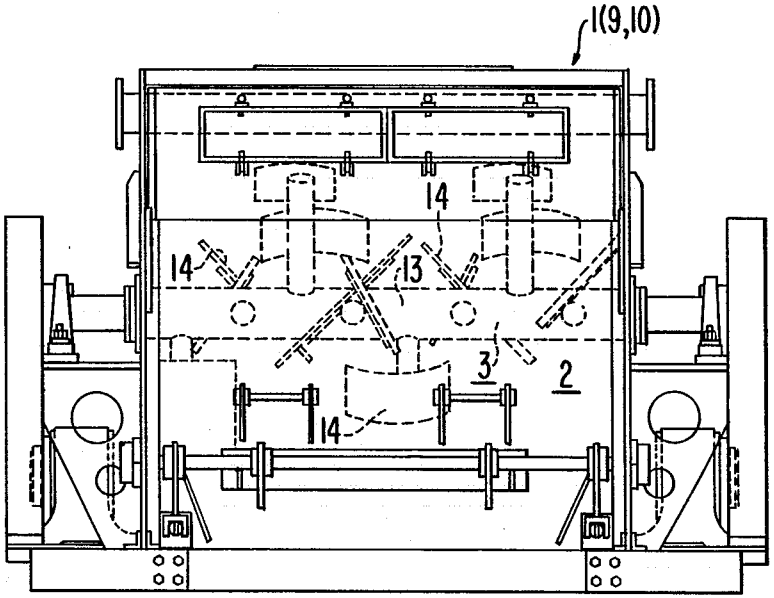

FIG. 1 shows a schematic view of a cellular concrete paste mixer unit of the invention. FIG. 2 and 3 illustrate a front and side elevational view of the mixer 1, respectively.

The drawings represent preferred embodiments of the mixer unit of the invention. In the drawing shown in FIG. 1, the reference number 1 designates the first mixer, in which cement and water and often aggregate are blended; 2 a housing of the mixer; 3 a rod for agitation, consisting of a shaft 13 and several blades 14 attached to it, as shown in FIGS. 2 and 3; 4 an inlet for cement; 5 an inlet for water; 6 an inlet for aggregate or other additives; 7 a belt conveyer to feed aggregate or additives; 8 a connection with change-over valve, through which the cement paste blended in the first mixer is distributed to the second mixers; 9 and 10 an increased number of second mixers, in which the cement paste and bubbled frother solution are simultaneously fed with agitation and blended to form a cellular concrete paste; 11 a feeder having an ability of agitation; 12 a form in which the cellular concrete paste solidifies; and 15 a frame of the unit.

The chief advantages of the cellular concrete paste mixer unit of the invention consist of the capability of the mixer unit in mixing the next batch of cement paste in the first mixer while the preceding cement paste and bubbled frother solution are blended in the increased number of second mixers, resulting in higher efficiency of production of cellular concrete paste; and in feeding simultaneously a bubbled frother solution and cement paste into the second mixer with agitation, leading to uniformity of cellular concrete paste without defoaming.

EXAMPLE 1

Production of cellular concrete manufacture using a mixer unit in accordance with the invention.

A cellular concrete paste mixer unit shown in FIG. 1 was used. 2000 kg of Portland cement (Nippon Cement) was charged from the inlet 4, 1000 kg of silica from the inlet 6, and 2000 kg of water from the inlet 5. The mixture was blended for 2 minutes in the mixer 1. The mixture was all fed to the mixer 9 through the connection 8. In the meantime, 200 kg of a frother solution (40 g of a sulfate of higher alcohol, Foamix C: Hamano Kogyo, in 160 kg of water) which had been aerated by a bubble generator was fed into the mixer 9 with agitation. The mixture in the mixer 9 was blended for 5 minutes to form a cellular concrete paste while the next batch of ingredients were fed to the mixer 1, blended for 2 minutes, and fed to the mixer 10. This procedure was continuously repeated. The resultant cellular concrete paste as transferred and allowed to stand for 28 days at room temperature to solidify.

The obtained cellular concrete manufacture was compared with the one produced by a prior art mixer unit having a single mixer; this was prepared in the same manner using the same ingredients as those of the above process, except that the bubbled frother solution was added afterward onto the cement paste which had been blended in the mixer. The used test plates were in the form of $4\times4\times16$ $cm^3$.

TABLE 1

| Example | Mixer Unit | Specific Gravity | Flexural Strength ($kg/cm^2$) |
|---|---|---|---|
| Control | Prior art mixer unit having a single mixer | 0.64 | 2.3 |
| Example | Mixer unit of the invention shown in FIG. 1 | 0.62 | 2.7 |

The improvement when using the cellular concrete paste mixer unit of the invention as compared with the Control is evident from the above data.

Since many embodiments of the invention may be made without departing from the spirit and scope thereof, it is to be understood that the invention is not limited by the specific examples, noted above.

What is claimed is:

1. A cellular concrete paste mixer unit comprising:

a frame, at least one first mixer, each first mixer adapted for receiving cement, water, aggregate, and additives, each first mixer having means for agitating the cement, water, aggregate and additives to produce a cement paste, each first mixer adapted to discharging the cement paste, a plurality of inlets for supplying cement, water, aggregate and additives to each first mixer, at least two second mixers adapted for receiving the cement paste produced by at least one first mixer, each of the second mixers adapted for receiving a bubbled frother solution, each of the second mixers having means for agitating the cement paste and the bubbled frother solution to produce a cellular concrete paste, at least one inlet for supplying the bubbled frother solution to each of the second mixers, and a connection having a change-over valve, said connection fluidly connected to each first mixer and each of the second mixers for conveying the cement paste from each first mixer to the second mixers, wherein the number of second mixers is always larger than the number of first mixers.

2. The cellular concrete paste mixer unit according to claim 1, further comprising a feeder adapted for receiving the cellular concrete paste from each of the second mixers, said feeder having a means for agitating the cellular concrete paste.

3. A process for making cellular concrete paste, which process comprises:

a. blending cement and water in at least one first mixer to produce cement paste, b. delivering the cement paste into at least two second mixers and also delivering into each of the second mixers without defoaming a bubbled frother solution, and c. blending the cement paste and the bubbled frother solution in each of the second mixers to produce a cellular concrete paste, wherein the number of second mixers is always larger than the number of first mixers.

4. The process according to claim 3, further comprising, after the step of delivering the cement paste from the at least one first mixer into the second mixers, repeating steps a. through c., thereby providing a continuous process for production of cellular concrete paste.

5. The process according to claim 3, further comprising the step of transferring the cellular concrete paste from the second mixers through a feeder into a form.

* * * * *